US009570255B2

(12) United States Patent
Gibson

(10) Patent No.: US 9,570,255 B2
(45) Date of Patent: Feb. 14, 2017

(54) ELECTRICAL SWITCHING APPARATUS, AND OPERATING HANDLE ASSEMBLY AND TRIP CAM THEREFOR

(71) Applicant: EATON CORPORATION, Cleveland, OH (US)

(72) Inventor: Jeffrey Scott Gibson, Hookstown, PA (US)

(73) Assignee: EATON CORPORATION, Cleveland, OH (US)

( * ) Notice: Subject to any disclaimer, the term of this patent is extended or adjusted under 35 U.S.C. 154(b) by 247 days.

(21) Appl. No.: 14/558,954

(22) Filed: Dec. 3, 2014

(65) Prior Publication Data

US 2016/0163479 A1 Jun. 9, 2016

(51) Int. Cl.

| | |
|---|---|
| ***H01H 21/22*** | (2006.01) |
| ***H01H 71/04*** | (2006.01) |
| ***H01H 69/01*** | (2006.01) |
| ***H01H 71/50*** | (2006.01) |

(52) U.S. Cl.

CPC ..... *H01H 21/22* (2013.01); *H01H 69/01* (2013.01); *H01H 71/04* (2013.01); *H01H 71/50* (2013.01); *H01H 2069/016* (2013.01); *H01H 2223/00* (2013.01); *H01H 2225/006* (2013.01)

(58) Field of Classification Search

CPC ..... H01H 71/04; H01H 69/01; H01H 71/50; H01H 21/22; H01H 2223/00; H01H 2069/016; H01H 2225/006

See application file for complete search history.

(56) References Cited

U.S. PATENT DOCUMENTS

| | | | | |
|---|---|---|---|---|
| 5,898,146 | A * | 4/1999 | Beck | H01H 77/104 200/244 |
| 6,917,267 | B2 | 7/2005 | Lias et al. | |
| 7,368,677 | B2 * | 5/2008 | Jones | H01H 3/3031 200/400 |
| 7,598,467 | B2 * | 10/2009 | Gibson | H01H 71/505 200/400 |
| 8,217,287 | B2 * | 7/2012 | Kil | H01H 71/503 200/332 |
| 9,343,256 | B1 * | 5/2016 | Gibson | H01H 71/04 |

* cited by examiner

*Primary Examiner* — Bernard Rojas
(74) *Attorney, Agent, or Firm* — Eckert Seamans; John Powers; Grant Coffield

(57) ABSTRACT

A trip cam is for an operating handle assembly of an electrical switching apparatus. The electrical switching apparatus includes a housing and a number of poles. The operating handle assembly includes an operating handle partially extending into the housing and a cradle member cooperating with the operating handle. The trip cam includes: a mounting portion structured to be disposed in the housing, the mounting portion including a first region, a second region disposed generally opposite the first region, and a third region disposed generally between the first region and the second region; a transfer leg extending from the first region and being structured to cooperate with each of the number of poles; a driving leg extending from the third region and being structured to be driven by the cradle member; and an operating handle protrusion extending from the second region and being structured to engage the operating handle.

20 Claims, 11 Drawing Sheets

ELECTRICAL SWITCHING APPARATUS, AND OPERATING HANDLE ASSEMBLY AND TRIP CAM THEREFOR

CROSS-REFERENCE TO RELATED APPLICATIONS

This application is related to commonly assigned, concurrently filed

U.S. patent application Ser. No. 14/558,921, filed Dec. 03, 2014, and entitled "ELECTRICAL SWITCHING APPARATUS AND CONTACT ASSEMBLY THEREFOR"; and U.S. patent application Ser. No. 14/558,928, filed Dec. 03, 2014, and entitled "ELECTRICAL SWITCHING APPARATUS, AND INDICATION ASSEMBLY AND TRIP CAM THEREFOR".

BACKGROUND

Field

The disclosed concept pertains generally to electrical switching apparatus such as for example, circuit breakers. The disclosed concept also pertains to operating handle assemblies for electrical switching apparatus. The disclosed concept further relates to trip cams for operating handle assemblies.

Background Information

Electrical apparatus, such as electrical switching apparatus or electrical meters used in power distribution systems, are often mounted on or within an electrical enclosure (e.g., without limitation, a panelboard; a load center; a meter breaker panel) either individually or in combination with other electrical meters or switchgear (e.g., without limitation, circuit switching devices and circuit interrupters such as circuit breakers, contactors, motor starters, motor controllers and other load controllers). Such circuit breakers are used to protect electrical circuitry from damage due to a trip condition, such as, for example, an overcurrent condition, an overload condition, an undervoltage condition, a relatively high level short circuit or fault condition, a ground fault or arc fault condition.

Molded case circuit breakers, for example, include at least one pair of separable contacts which are operated either manually by way of a handle disposed on the outside of the case, or automatically by way of a trip unit in response to the trip condition. Generally, the trip unit includes a cradle assembly which is operable between a latched configuration during normal circuit breaker operation, and an unlatched position in which the separable contacts are tripped open, in response to the trip condition.

Known circuit breakers employ relatively large mechanism spring forces to assure adequate contact pressures. However, these forces generate relatively significant friction at component interfaces. In many situations, this friction significantly restricts the movement of circuit breaker components, potentially causing the operating handle to become undesirably stuck in an unintended position.

There is thus room for improvement in electrical switching apparatus, and in operating handle assemblies and trip cams therefor.

SUMMARY

These needs and others are met by embodiments of the disclosed concept wherein a trip cam is provided which among other benefits, enables an operating handle to move between positions during a tripping operation.

In accordance with one aspect of the disclosed concept, a trip cam for an operating handle assembly of an electrical switching apparatus is provided. The electrical switching apparatus comprises a housing and a number of poles. The operating handle assembly comprises an operating handle partially extending into the housing and a cradle member cooperating with the operating handle. The trip cam comprises: a mounting portion structured to be disposed in the housing, the mounting portion comprising a first region, a second region disposed generally opposite the first region, and a third region disposed generally between the first region and the second region; a transfer leg extending from the first region and being structured to cooperate with each of the number of poles; a driving leg extending from the third region and being structured to be driven by the cradle member; and an operating handle protrusion extending from the second region and being structured to engage the operating handle.

As another aspect of the disclosed concept, an operating handle assembly for an electrical switching apparatus is provided. The electrical switching apparatus comprises a housing and a number of poles. The operating handle assembly comprises: an operating handle partially extending into the housing; a cradle member cooperating with the operating handle; and a trip cam comprising: a mounting portion structured to be disposed in the housing, the mounting portion comprising a first region, a second region disposed generally opposite the first region, and a third region disposed generally between the first region and the second region, a transfer leg extending from the first region and being structured to cooperate with each of the number of poles, a driving leg extending from the third region and being structured to be driven by the cradle member, and an operating handle protrusion extending from the second region and being structured to engage the operating handle.

As a further aspect of the disclosed concept, an electrical switching apparatus comprises: a housing; a number of poles; and at least one operating handle assembly comprising: an operating handle partially extending into the housing, a cradle member cooperating with the operating handle, and a trip cam comprising: a mounting portion disposed in the housing, the mounting portion comprising a first region, a second region disposed generally opposite the first region, and a third region disposed generally between the first region and the second region, a transfer leg extending from the first region and cooperating with each of the number of poles, a driving leg extending from the third region and being structured to be driven by the cradle member, and an operating handle protrusion extending from the second region and being structured to engage the operating handle.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the statement that two or more parts are "connected" or "coupled" together shall mean that the parts are joined together either directly or joined through one or more intermediate parts.

As employed herein, the statement that two or more parts or components "engage" one another shall mean that the parts touch and/or exert a force against one another either directly or through one or more intermediate parts or components.

Figure 1:
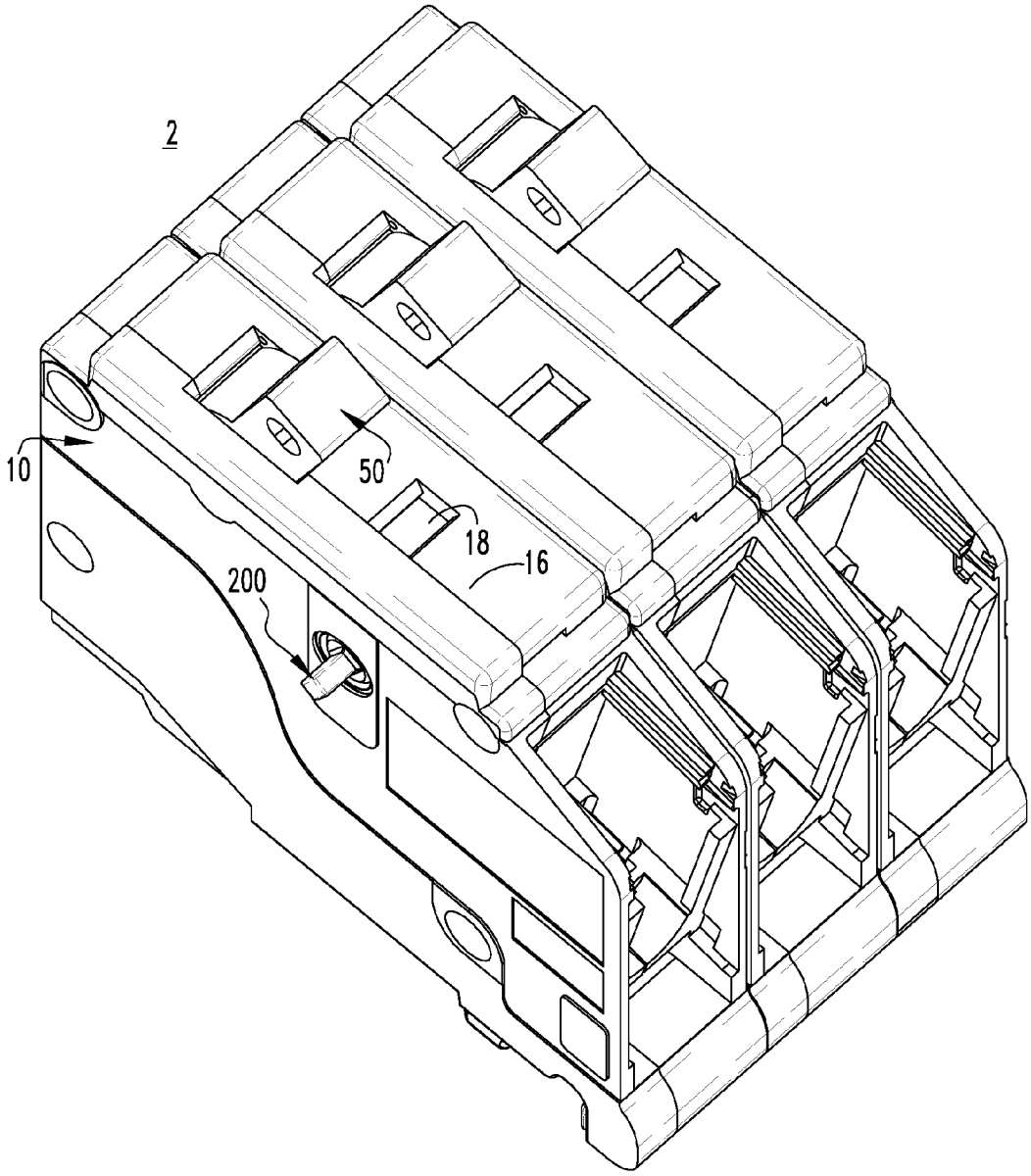
FIG. 1 is an isometric view of an electrical switching apparatus, in accordance with an embodiment of the disclosed concept.

FIG. 1 shows an electrical switching apparatus (e.g., without limitation, circuit breaker 2) in accordance with the disclosed concept. The example circuit breaker 2 includes a housing 10, a number of operating handles (one operating handle 50 is indicated) extending into the housing 10, and a number of trip cams (only one trip cam 200 is partially visible in FIG. 1) located within the housing 10.

Figure 2:
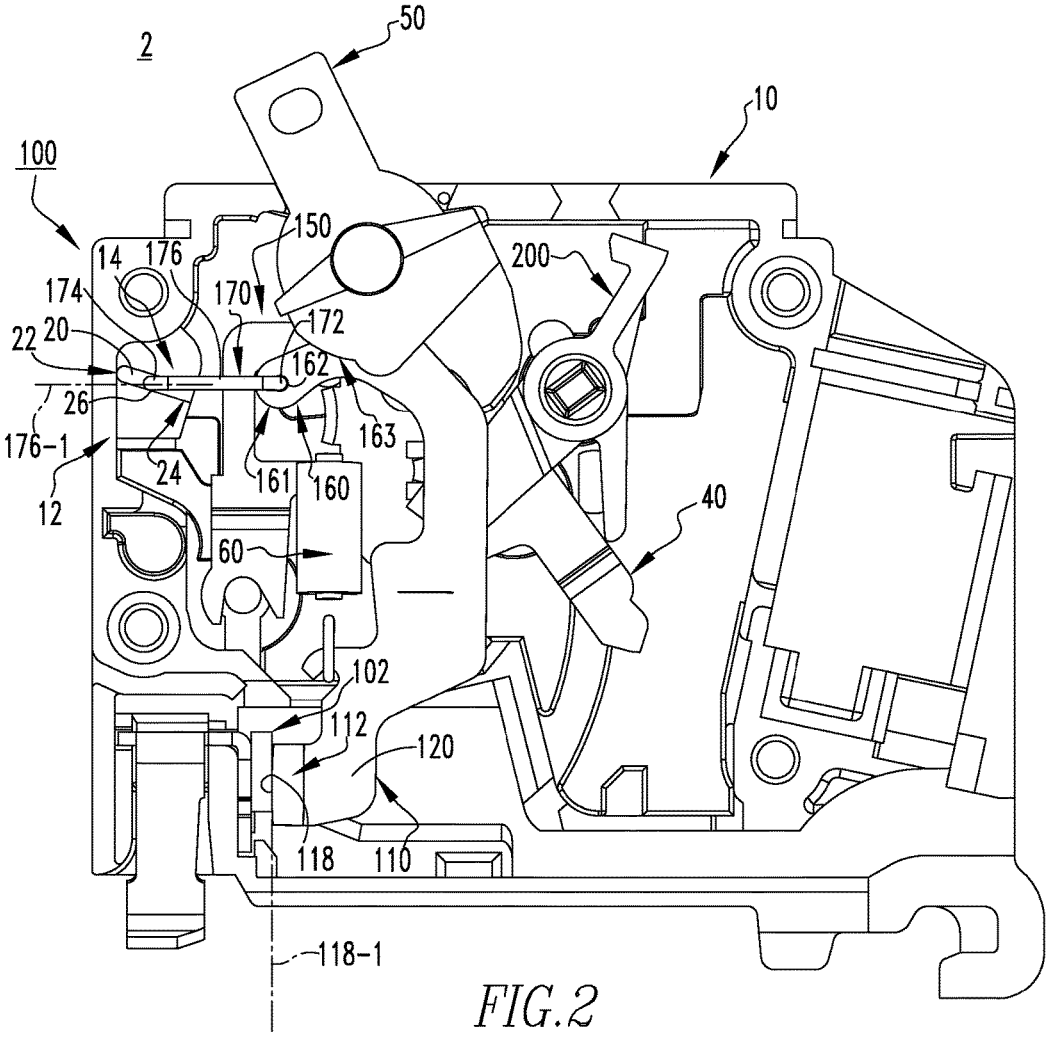
FIG. 2 is an elevation view of the electrical switching apparatus of FIG. 1, shown with the movable arm in the CLOSED position and with portions of the electrical switching apparatus removed to show hidden structures.
Figure 3:
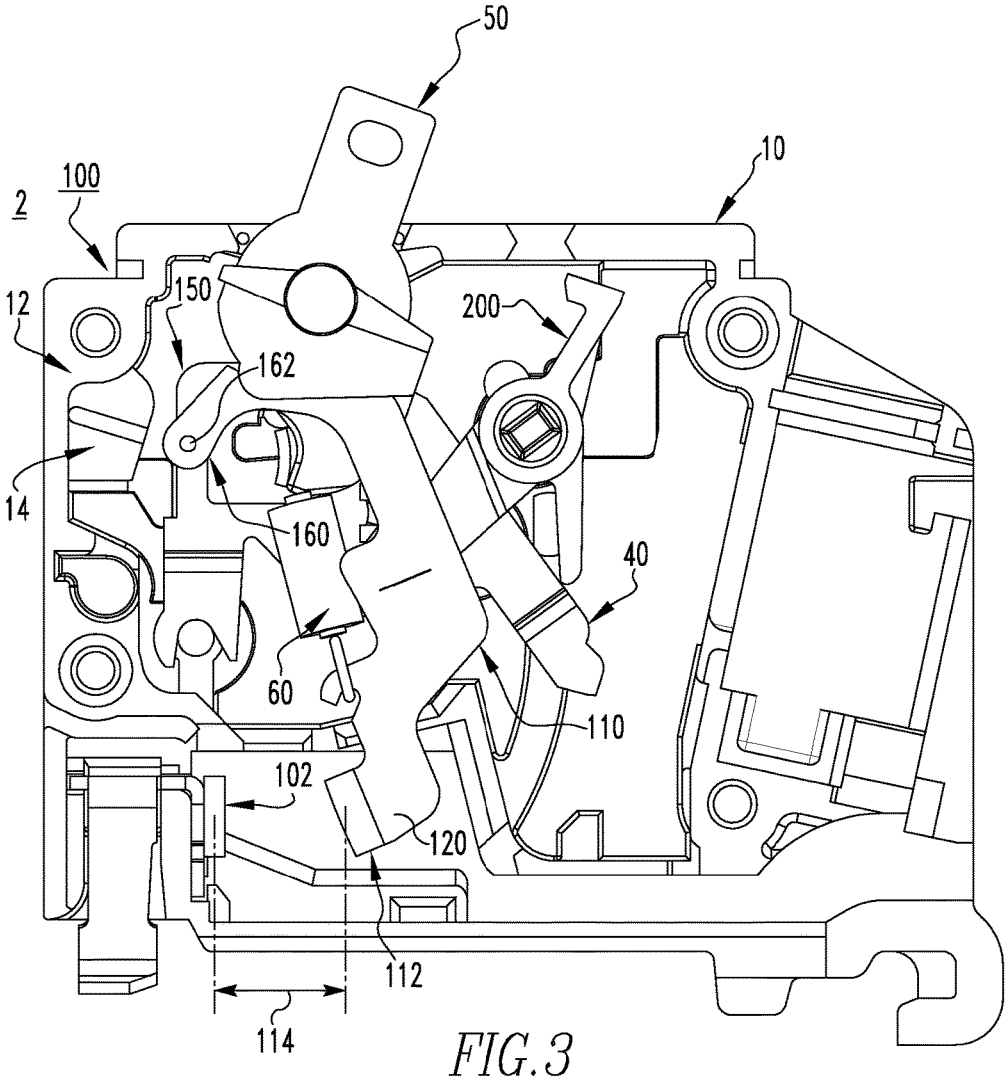
FIG. 3 is an elevation view of the electrical switching apparatus of FIG. 2, showing the movable arm in an open position.
Figure 4:
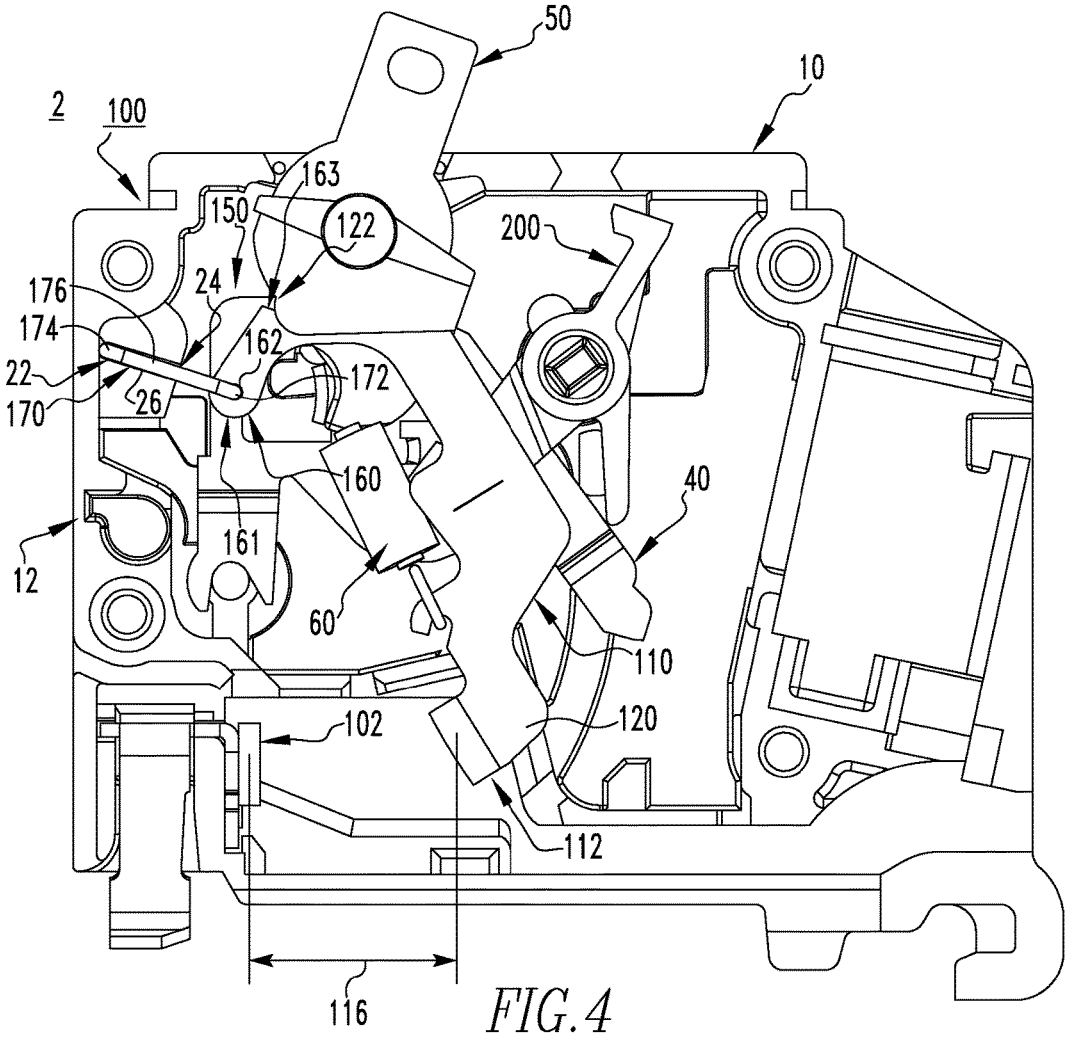
FIG. 4 is an elevation view of the electrical switching apparatus of FIG. 2, showing the movable arm in an EXTENDED OPEN position.

FIGS. 2 through 4 show different views of the circuit breaker 2 with portions removed in order to see internal components. As seen, the circuit breaker 2 further includes a cradle member 40 located in and engaging the housing 10, an operating mechanism (e.g., without limitation, spring 60) coupled to the cradle member 40, and a contact assembly 100. The circuit breaker 2 has a number of poles and a corresponding contact assembly (e.g., without limitation, substantially similar to or the same as the contact assembly 100) for each of the poles of the circuit breaker 2.

Continuing to refer to FIGS. 2 through 4, the contact assembly 100 includes a stationary contact 102 located in the housing 10, and a movable arm 110. The movable arm 110 has a movable contact 112 structured to engage the stationary contact 102. As will be discussed in greater detail hereinbelow, the movable arm 110 is structured to move between a CLOSED position (FIG. 2) and an EXTENDED OPEN position (FIG. 4). In order to maintain the movable arm 110 in the EXTENDED OPEN position (FIG. 4), the contact assembly 100 advantageously further includes an extension apparatus 150 located on the housing 10.

Figure 5:
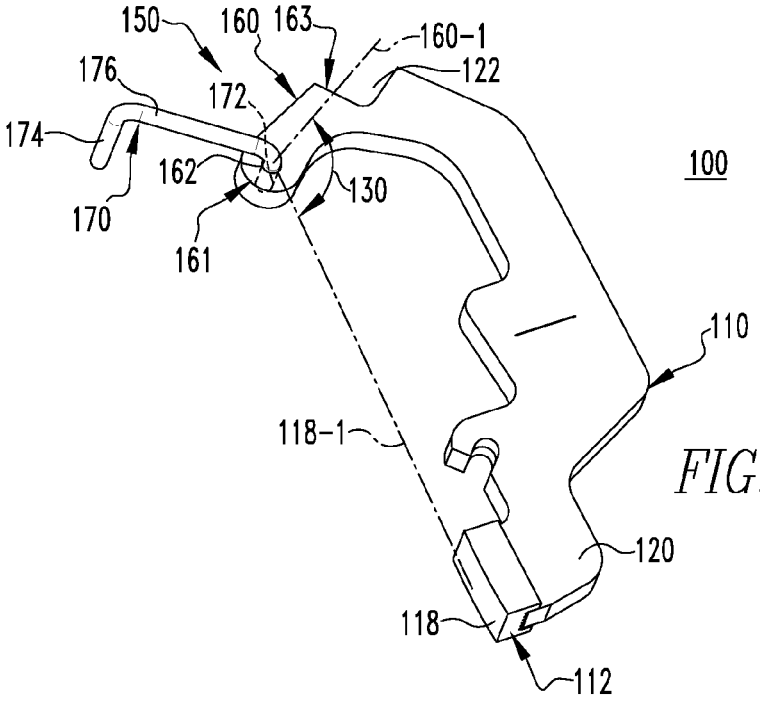
FIG. 5 is an isometric view of a portion of the contact assembly for the electrical switching apparatus of FIG. 4.

As seen in FIG. 5, the extension apparatus 150 includes a generally U-shaped link member 170 and an elongated extension 160 located on the movable arm 110. The link member 170 is coupled to the elongated extension 160 and further structured to be located on and engage the housing 10, as will be discussed below. The movable arm 110 includes a distal portion 120 located proximate the movable contact 112 and opposite the elongated extension 160. Furthermore, the movable arm 110 has a cutout 122 located between the elongated extension 160 and the distal portion 120. In operation, the operating handle 50 is structured to be located in the cutout 122, as shown in FIG. 4. Additionally, the elongated extension 160 extends from the movable arm 110 proximate the cutout 122. In the example non-limiting embodiment, the elongated extension 160 is integral with the movable arm 110. Stated differently, the movable arm 110, and thus the elongated extension 160, preferably form a single unitary component composed of the same single piece of material (as opposed to a plurality of separate components being joined together). However, it will be appreciated that an elongated extension (not shown) may be an individual component separately coupled to a movable arm (not shown), without departing from the scope of the disclosed concept.

Continuing to refer to FIG. 5, the link member 170 includes a pair of opposing legs 172 (partially shown in hidden line drawing), 174 and a middle portion 176 generally normal to the legs 172,174 and connecting the leg 172 to the leg 174. As seen, the elongated extension 160 includes a pair of spaced apart and opposing end portions 161,163. Furthermore, the elongated extension 160 has an aperture 162 located proximate the end portion 161. The leg 172 of the link member 170 at least partially extends into the aperture 162 of the elongated extension 160 in order to couple the link member 170 to the elongated extension 160, and thus the movable arm 110. Moreover, the movable contact 112 includes a contact surface 118 located in a plane (indicated generally as 118-1), and the elongated extension 160 has a longitudinal axis 160-1 at an angle 130 with the plane 118-1. As seen, the angle 130 is preferably greater than 90 degrees. It will be appreciated that when the movable arm 110 is in the EXTENDED OPEN position, the extension apparatus 150, and particularly the configuration of the elongated extension 160 and its relation with the link member 170, and internal portion 14 of housing 10, advantageously enables the movable arm 110 to be maintained in the EXTENDED OPEN position (FIG. 4), as will be discussed in greater detail hereinbelow. It will also be appreciated that an extension apparatus (not shown) may have any known or suitable alternative shape and/or configuration to perform the desired function of maintaining the movable arm 110 in an EXTENDED OPEN position.

Figure 6:
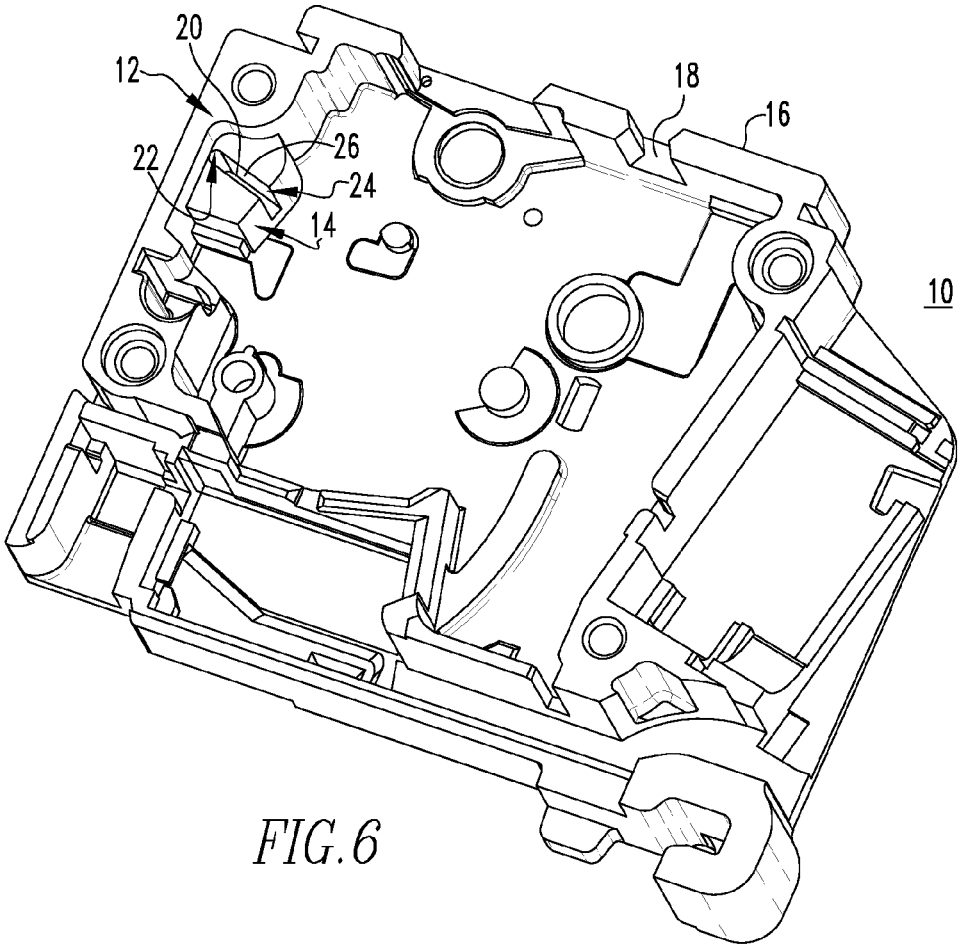
FIG. 6 is an isometric view of a portion of the housing for the electrical switching apparatus of FIG. 4.

FIG. 6 shows a portion of the example housing 10. As seen, the housing 10 includes a wall portion 12 and an internal portion 14 adjacent the wall portion 12. The internal portion 14 has a slot 20 that has a pair of opposing and spaced apart end portions 22,24 and a center portion 26 located generally midway between the end portions 22,24. The end portion 22 is adjacent the wall portion 12 and the end portion 24 is internal with respect to the wall portion 12.

Referring again to FIG. 2, in which the movable arm 110 is in the CLOSED position, the leg 174 of the link member 170 is located on the housing 10 proximate the center portion 26 of the slot 20 (i.e., spaced from the end portion 22). Although the leg 174 partially extends into the slot 20, it is within the scope of the disclosed concept for an internal portion (not shown) to alternatively include a slot for a leg (not shown) to extend entirely therethrough. Additionally, the middle portion 176 of the link member 170 has a longitudinal axis 176-1 that is generally normal to the plane 118-1 of the contact surface 118, as shown.

Furthermore, FIG. 2 shows the operating handle 50 is in an ON position. Responsive to the operating handle 50 moving from the ON position toward an OFF position (FIGS. 3 and 4), the movable arm 110 moves from the CLOSED position (FIG. 2) toward the EXTENDED OPEN position (FIG. 4). It will further be appreciated that responsive to the movable arm 110 moving from the CLOSED position (FIG. 2) toward the EXTENDED OPEN position (FIG. 4), the cradle member 40 remains substantially stationary. In other words, the example extension apparatus 150 is significantly advantageous when the operating handle 50 is manually moved between ON and OFF positions.

FIG. 3 shows the movable arm 110 in an open position. For ease of illustration and purposes of discussion, the contact assembly 100 is illustrated in FIG. 3 without the link member 170 (FIGS. 2, 4 and 5). As will be discussed below, by incorporating the link member 170 with the elongated extension 160, the movable arm 110 is advantageously able to be maintained in the EXTENDED OPEN position (FIG. 4). Additionally, in the open position of FIG. 3, the spring 60 is in a static position in which it does not tend to cause the movable arm 110 to rotate one direction or the other. Furthermore, as seen, the movable contact 112 is spaced a distance 114 from the stationary contact 102.

FIG. 4 shows the movable arm 110 in the EXTENDED OPEN position. In this position, the movable contact 112 is spaced a distance 116 from the stationary contact 102. The distance 116 (FIG. 4) is greater than the distance 114 (FIG. 3). In other words, the movable contact 112 is spaced a farther distance from the stationary contact 102 in the EXTENDED OPEN position than in the open position of FIG. 3. Additionally, in the EXTENDED OPEN position (FIG. 4), the elongated extension 160 extends from proximate the cutout 122 toward the stationary contact 102, and the middle portion 176 generally overlies and is parallel to the slot 20.

Furthermore, responsive to the operating handle 50 moving from the ON position (FIG. 2) to the OFF position (FIG. 4), the leg 174 of the link member 170 slides in the slot 20 from proximate the center portion 26 to the end portion 22 and exerts a force on the wall portion 12 of the housing 10. In this manner, the movable arm 110 to be maintained in the EXTENDED OPEN position (FIG. 4). Thus, responsive to the movable arm 110 moving from the CLOSED position (FIG. 2) toward the EXTENDED OPEN position (FIG. 4), the end portion 163 of the elongated extension 160 moves toward the leg 174 of the link member 170, and the leg 174 of the link member 170 moves away from the distal portion 120 of the movable arm 110.

Moreover, as the operating handle 50 is rotated toward the OFF position (FIGS. 3 and 4), the stored energy of the spring 60 initially forces the movable arm 110 to move from the CLOSED position (FIG. 2) toward the EXTENDED OPEN position (FIG. 4). After the spring 60 passes its static position (also the OFF position)(FIG. 3), inertia allows the movable arm 110 to continue rotating to the EXTENDED OPEN position (FIG. 4). Typically, the movable arm 110 would rotate from the EXTENDED OPEN position (FIG. 4) back toward the CLOSED position (FIG. 2), and continue to oscillate until it became steady in the open position shown in FIG. 3. However, when the movable arm 110 initially reaches the EXTENDED OPEN position (FIG. 4), the leg 174 of the link member 170 engages and substantially presses against the wall portion 12 of the housing 10 in order to maintain the movable arm 110 in the EXTENDED OPEN position (FIG. 4). The wall portion 12 exerts an opposing force on the link member 170, which in turn exerts a moment on the movable arm 110 to advantageously maintain the movable arm 110 in the EXTENDED OPEN position (FIG. 4). Thus, the stored energy of the spring 60 forces the movable arm 110 to the EXTENDED OPEN position (FIG. 4) and the extension apparatus 150 in turn advantageously maintains the movable arm 110 in the EXTENDED OPEN position (FIG. 4). Stated differently, when the movable arm 110 is in the EXTENDED OPEN position, the extension apparatus 150 retains the movable arm 110 in the EXTENDED OPEN position until an operator moves the operating handle 50 from the OFF position toward the ON position, which causes the movable arm 110 to be released from the EXTENDED OPEN position and move toward the CLOSED position.

It is well known that a circuit breaker having minimal contact separation while moving from ON to OFF positions will have extended arcing times. This in turn results in excessive damage to the electrical contacts, which corresponds to elevated resistance and subsequent failure due to exceeding temperature rises when conducting current. Thus, it will be appreciated that the stationary contact 102 and the movable contact 112 are significantly well protected. Specifically, responsive to the operating handle 50 moving from the ON position (FIG. 2) to the OFF position (FIG. 4), the movable contact 112 moves past the open position shown in FIG. 3 to the EXTENDED OPEN position (FIG. 4), and is maintained at a farther distance from the stationary contact 102 (i.e., the distance 116 is greater than the distance 114). Thus, arcing times, device resistance, and temperature rises are all decreased by employing the extension apparatus 150. Additionally, problematic oscillations associated with prior art equilibrium open positions, which result in momentary reduced contact gaps, are eliminated. In this manner, the circuit breaker 2, particularly the stationary contact 102 and the movable contact 112, are advantageously well protected.

Accordingly, it will be appreciated that the disclosed concept provides for an improved (e.g., without limitation, reduced electrical resistance and increased protection from damage due to temperature rises) electrical switching apparatus (e.g., without limitation, circuit breaker 2), and contact assembly therefor, which among other benefits, provides additional separation for electrical contacts (e.g., without limitation, stationary contact 102 and movable contact 112).

FIGS. 7A-7F show different views of the trip cam 200 for the circuit breaker 2 (FIGS. 1-4). In the illustrated embodiment, the trip cam 200 includes a generally cylindrical-shaped mounting portion 210, a transfer leg 212, a driving leg 214, and a trip indicator leg 220. Although the circuit breaker 2 (FIGS. 1-4) has been described hereinabove in association with the operating handle 50 being manually moved from ON to OFF positions, when the circuit breaker 2 (FIGS. 1-4) does undergo a tripping event (e.g., without limitation, an overcurrent condition), the transfer leg 212 cooperates with each of the poles of the circuit breaker 2 (FIGS. 1-4) in a manner generally well known in the art. Additionally, during the tripping operation, the cradle member 40 (FIGS. 2-4) drives the driving leg 214, as will be discussed in greater detail hereinbelow.

Figure 7A:
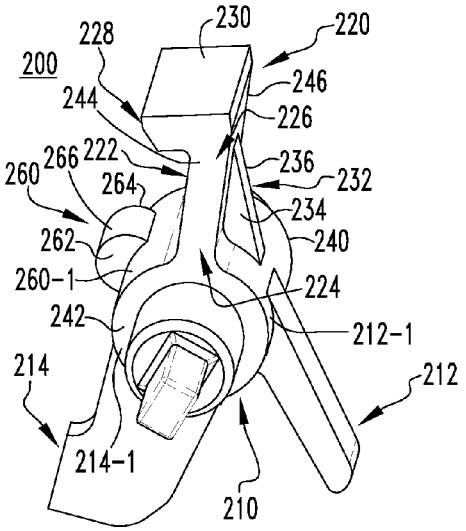
FIGS. 7A-7F are different views of a trip cam for the electrical switching apparatus of FIG. 1.
Figure 7B:
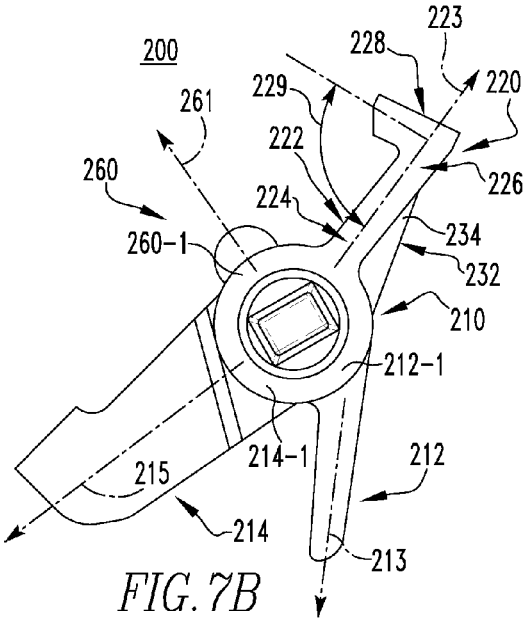
Figure 7C:
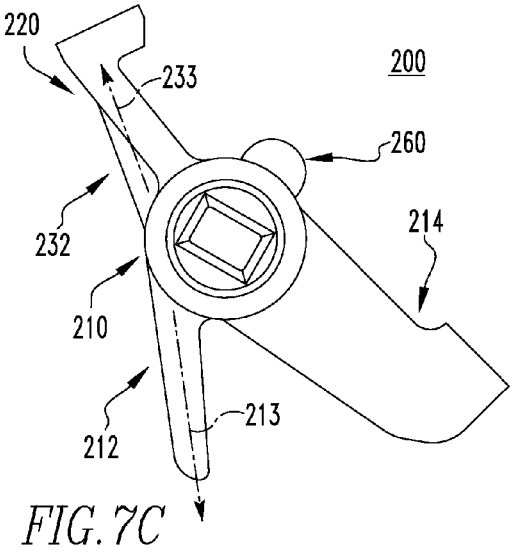

Referring to FIG. 7B, the transfer leg 212 extends from the mounting portion 210 in a direction 213 and the driving leg 214 extends from the mounting portion 210 in a direction 215. Furthermore, the trip indicator leg 220 includes a base portion 222 that extends from the mounting portion 210 in a direction 223 generally opposite the direction 215. This position of the trip indicator leg 220 advantageously enables the trip cam 200 to provide a visual indication of circuit status within the circuit breaker 2 (FIGS. 1-4, 11 and 12), as will be discussed in greater detail hereinbelow.

Continuing to refer to FIGS. 7A and 7B, the base portion 222 includes a pair of opposing and spaced apart end portions 224,226. The end portion 224 extends from the mounting portion 210 and the trip indicator leg 220 further has a trip flag 228 that extends from the end portion 226 at an angle 229. As seen, the angle 229 is preferably less than 100 degrees. The trip flag 228 has a generally rectangular-shaped trip indicating surface 230 (FIG. 7A), the function of which will be described below. The trip indicator leg 220 further includes a support portion 232 that extends from the base portion 222 and further extends from the mounting portion 210 in a direction 233 (FIG. 7C) generally opposite the direction 213. During the tripping operation, responsive to the cradle member 40 driving the driving leg 214, the trip cam 200 rotates about the mounting portion 210. Because of the relatively high rotational velocity of the trip cam 200, the support portion 232 advantageously provides support for the trip indicator leg 220.

The support portion 232 includes a pair of generally triangular-shaped parallel surfaces 234,236. The triangular-shaped surfaces 234,236 substantially extend along the base portion 222 as well as the mounting portion 210 (see FIGS. 7A-7C). Thus, support for the trip indicator leg 220 is advantageously further increased. The triangular-shaped surface 234 is opposite and spaced apart from the triangular-shaped surface 236. Of course, it will be appreciated that a support portion (not shown) may have any known or suitable alternative shape and/or configuration and/or interaction with the base portion 222 and the mounting portion 210 in order to perform the desired function of supporting the trip indicator leg 220 during the tripping operation. Additionally, the mounting portion 210 includes a pair of generally parallel end surfaces 240,242 and the base portion 222 extends from proximate the end surface 240 to proximate the end surface 242. Thus, there is a relatively strong connection between the base portion 222 and the mounting portion 210.

Figure 7D:
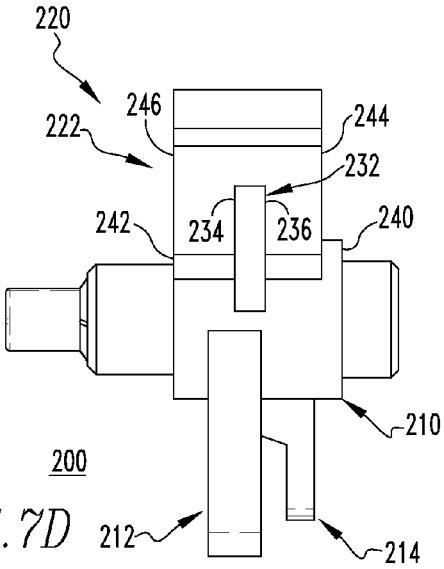
Figure 7E:
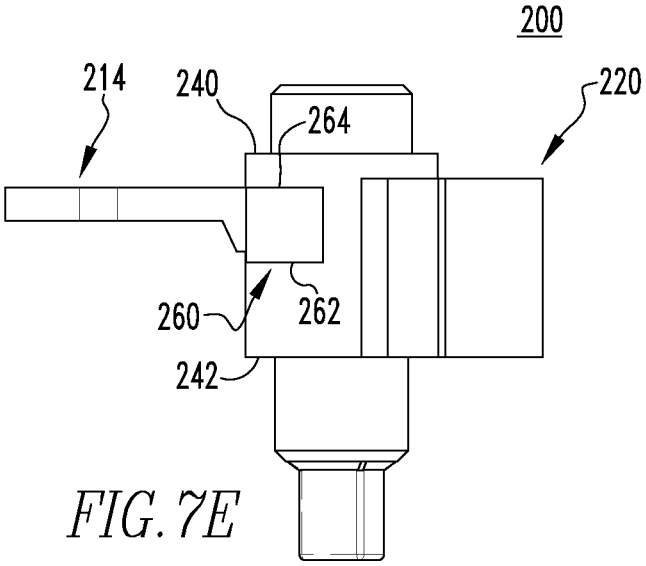
Figure 7F:
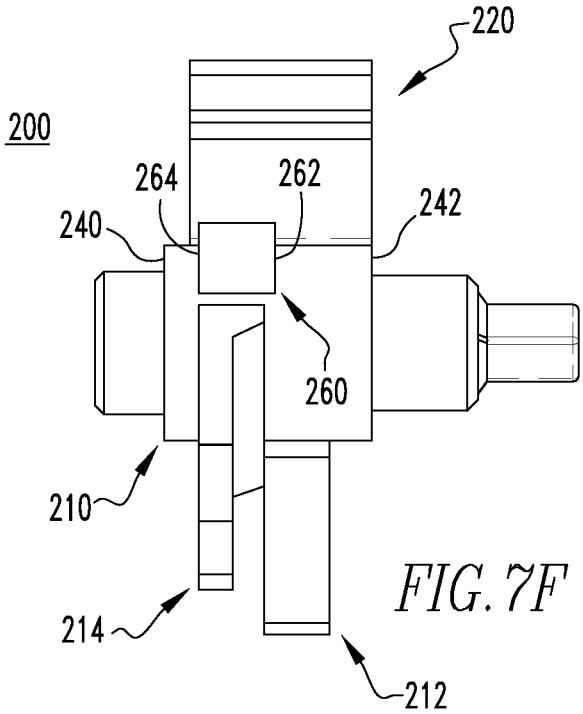

Furthermore, the base portion 222 includes a pair of generally rectangular-shaped parallel side surfaces 244,246. The side surface 244 extends from proximate the end surface 242 of the mounting portion 210. The side surface 246 extends from proximate the end surface 240 of the mounting portion 210 and is opposite and spaced apart from the side surface 244. As seen in FIG. 7D, the surfaces 234,236,240, 242,244,246 are generally parallel to each other. Additionally, the support portion 232 is located generally midway between the end surfaces 240,242. In this manner, as the trip cam 200 rotates during the tripping operation, the structure of the trip indicator leg 220 significantly enables the trip indicator leg 220 to remain relatively stable.

Figure 8:
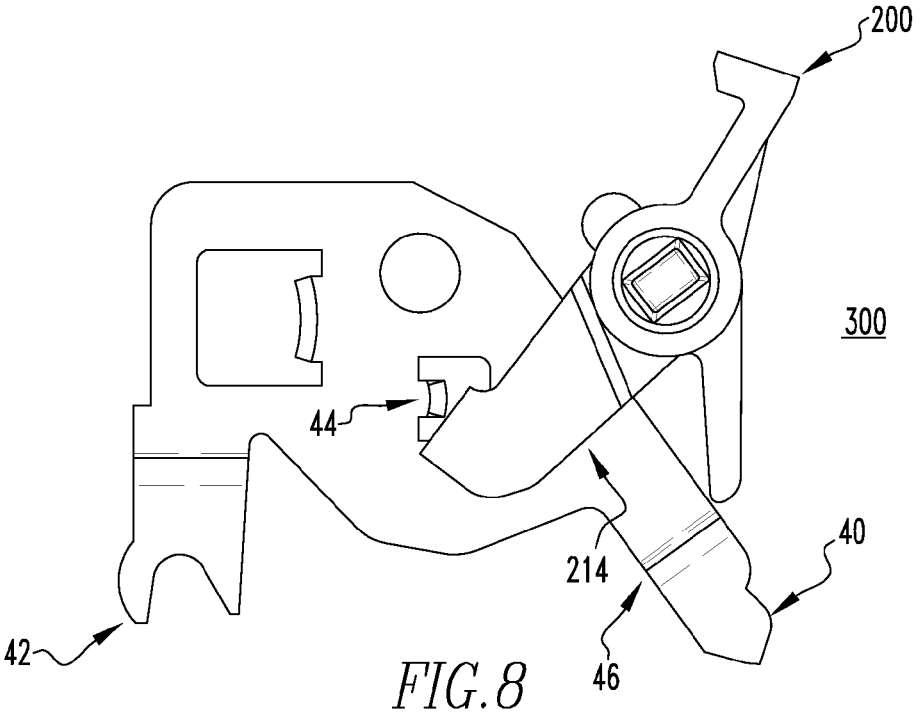
FIG. 8 is an elevation view of an indication assembly for the electrical switching apparatus of FIG. 1, shown in the loaded position.
Figure 9:
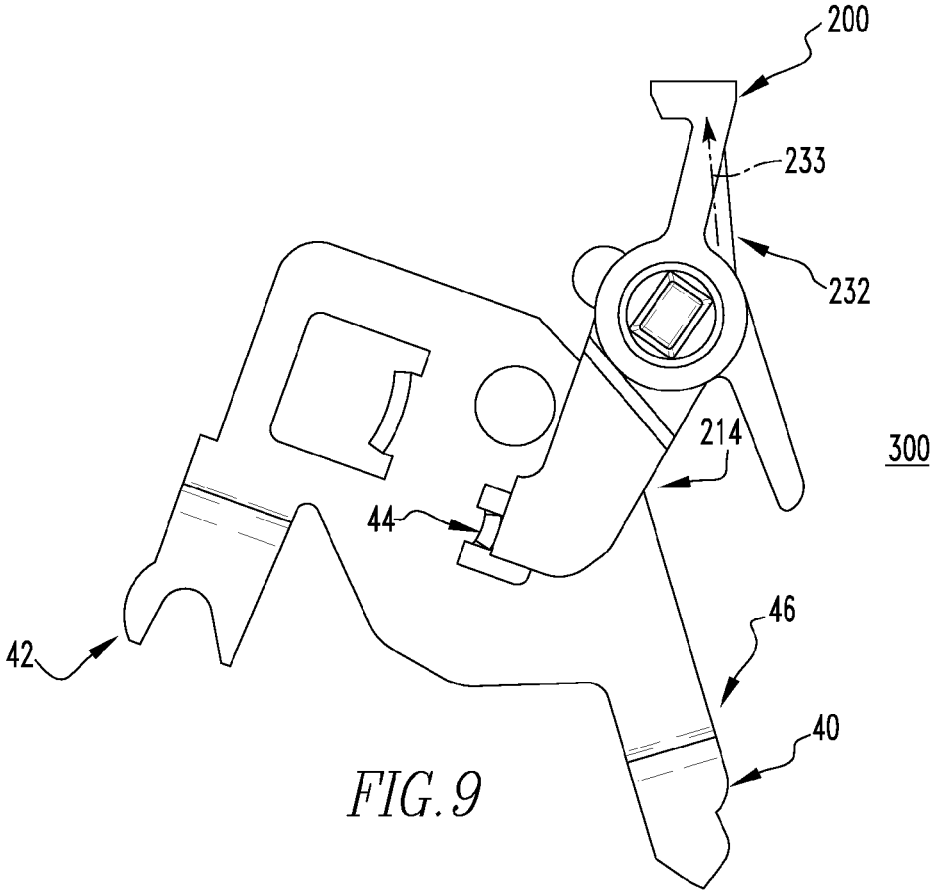
FIG. 9 is an elevation view of the indication assembly of FIG. 8, shown in the unloaded position.

FIGS. 8 and 9 show an indication assembly 300 for the circuit breaker 2 (FIGS. 1-4). The indication assembly 300 includes the cradle member 40 and the trip cam 200. More specifically, the indication assembly 300 is structured to move between a loaded position (FIG. 8) corresponding to the contacts 102,112 (FIGS. 2-4) being CLOSED and an unloaded position (FIG. 9) corresponding to the contacts 102,112 (FIGS. 2-4) in the different position shown, after having TRIPPED OPEN.

Furthermore, the cradle member 40 includes a hook portion 42, a protrusion 44 and an extension arm 46. The protrusion 44 is located between the hook portion 42 and the extension arm 46. The hook portion 42 is opposite the extension arm 46 and engages the housing 10. As seen, responsive to the indication assembly 300 moving from the loaded position (FIG. 8) toward the unloaded position (FIG. 9), the protrusion 44 drives the driving leg 214 of the trip cam 200. As will be discussed below in connection with FIGS. 11 and 12, it follows that responsive to the driving leg 214 being driven by the cradle member 40, the trip indicator leg 220 rotates about the mounting portion 210.

Figure 11:
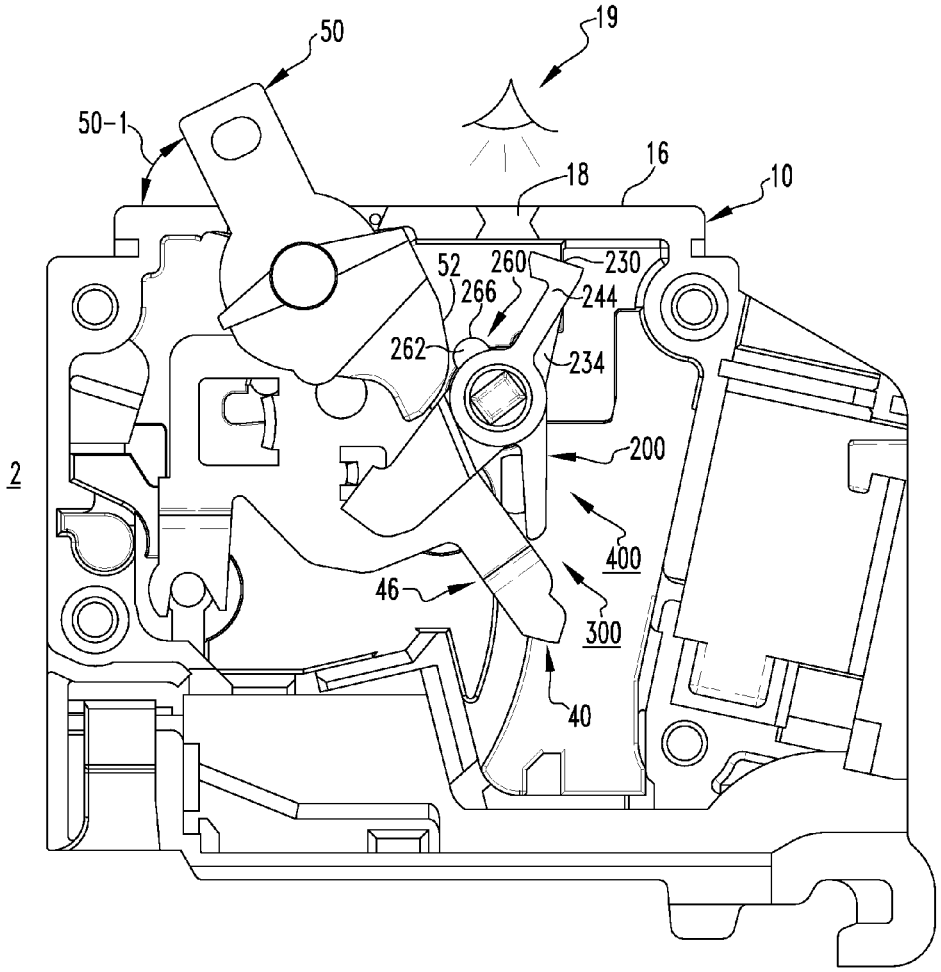
FIG. 11 is an elevation view of the operating handle assembly of FIG. 10 as employed in a portion of the electrical switching apparatus, showing the cradle member in the CLOSED position.
Figure 12:
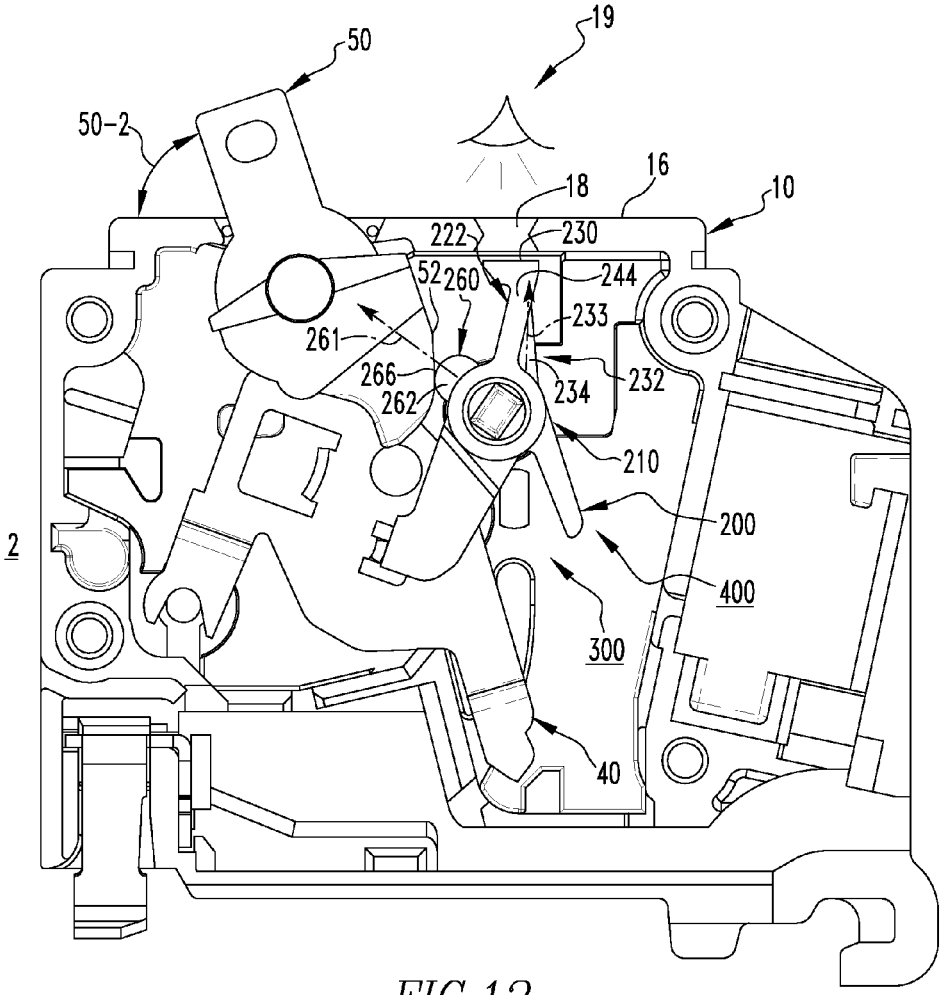
FIG. 12 is an elevation view of the operating handle assembly of FIG. 11, showing the cradle member in the TRIPPED position.

FIGS. 11 and 12 show different views of the indication assembly 300 employed in a portion of the circuit breaker 2. Specifically, FIG. 11 shows the circuit breaker 2 with the indication assembly 300 in the loaded position and FIG. 12 shows the circuit breaker 2 with the indication assembly 300 in the unloaded position. The housing 10 includes a generally planar external surface 16 (see also, for example, FIGS. 1 and 6) that has a window 18. Although only the window 18 and the indication assembly 300 are described herein, it will be appreciated that the circuit breaker 2 includes a plurality of windows and a plurality of indication assemblies for each of the poles. It will further be appreciated that responsive to any one of the indication assemblies (only one indication assembly 300 is shown) moving from the loaded position to the unloaded position, each of the other indication assemblies also moves from a corresponding loaded position to a corresponding unloaded position.

The side surfaces 244 (see FIGS. 7A and 7D for side surface 246) and the triangular-shaped surfaces 234 (see FIGS. 7A and 7D for triangular-shaped surface 236) of the trip cam 200 are generally normal to the external surface 16. As seen, when the indication assembly 300 is in the unloaded position (FIG. 12), the direction 233 is generally parallel to the extension arm 46 and is substantially normal to the external surface 16.

Continuing to refer to FIG. 11, when looking through the window 18 at an observation point 19 (i.e., an observation point directly above and looking into the window 18), the trip indicating surface 230 is not visible. Responsive to the indication assembly 300 moving from the loaded position (FIGS. 8 and 11) toward the unloaded position (FIGS. 9 and 12), the trip indicating surface 230 moves from a position where it is not visible through the window 18 from the observation point 19, toward a position where it is substantially located in the window 18. In this position (i.e., the unloaded position), the trip indicating surface 230 is visible through the window 18 from the observation point 19.

Stated differently, when the indication assembly 300 is in the unloaded position, an operator looking through the window 18 would observe the trip indicating surface 230. Thus, in the unloaded position the trip indicating surface 230 substantially faces the observation point 19 and there is nothing (e.g., housing 10) between the trip indicating surface 230 and the observation point 19. Stated differently, in the unloaded position light is able to pass directly from the observation point 19 to the trip indicating surface 230. By contrast, when the indication assembly 300 is in the loaded position, the operator looking through the window 18 from the observation point 19 would not be able to see the trip indicating surface 230. Specifically, in the loaded position the trip indicating surface 230 substantially faces the housing 10, which is located between the observation point 19 and the trip indicating surface 230. Thus, in the loaded position light is not able to pass directly from the observation point 19 to the trip indicating surface 230.

Because the loaded position corresponds to the contacts 102,112 (FIGS. 2-4) being CLOSED and the unloaded position corresponds to the contacts 102,112 (FIGS. 2-4) having TRIPPED OPEN, circuit status within the circuit breaker 2 is advantageously able to be determined by employing the trip indicator leg 220. Specifically, a visible trip indicating surface 230 from the observation point 19 signals that the contacts 102,112 (FIGS. 2-4) have TRIPPED OPEN. The absence of the trip indicating surface 230 from the observation point 19 signals that the contacts 102,112 (FIGS. 2-4) are CLOSED, or that the circuit breaker 2 has been manually opened. While the disclosed concept has been described in association with the base portion 222 extending in the direction 223 in order to have a visible trip indicating surface 230 when the contacts 102,112 (FIGS. 2-4) have TRIPPED OPEN, it will be appreciated that a base portion (not shown) may extend in a suitable alternative direction without departing from the scope of the disclosed concept, so long as different indications correspond to different positions (i.e., CLOSED or manually being opened versus TRIPPED OPEN) of the contacts 102,112 (FIGS. 2-4). Additionally, the disclosed concept has been described in association with the generally rectangular-shaped trip indicating surface 230 and corresponding window 18. However, it will be appreciated that a trip indicating surface (not shown) and corresponding window (not shown) may have any known or suitable alternative shape and/or configuration in order to perform the desired function of enabling circuit status to be visually determined.

As an additional benefit, by employing the trip indicator leg 220 in conjunction with the trip cam 200, manufacturing is able to be simplified. More specifically, separate assemblies and/or mechanisms which provide visual indication of circuit status (not shown) no longer need to be employed because the separate function of indication of circuit status has been combined with the component (e.g., trip cam) whose primary function is to trip all poles of an electrical switching apparatus. This advantageously corresponds to a reduction in device cost and assembly time, as well as a more efficient use of available space. Additionally, the trip cam 200 is preferably a single piece of material (e.g., without limitation, an injection molded piece), thus further simplifying manufacturing and reducing cost.

Accordingly, it will be appreciated that the disclosed concept provides for an improved (e.g., without limitation, less expensive, easier to assemble, more compact) electrical switching apparatus (e.g., without limitation, circuit breaker 2), and indication assembly 300 and trip cam 200 therefor, which among other benefits, combines the functions of providing visual indication of circuit status with a means for tripping all poles of the circuit breaker 2.

Referring again to FIGS. 7A and 7B, the mounting portion 210 includes a first region 212-1, a second region 260-1 located generally opposite the first region 212-1, and a third region 214-1 located generally between the first region 212-1 and the second region 260-1. Each of the regions 212-1,214-1,260-1 generally extends from the end surface 240 of the mounting portion 210 to the end surface 242 of the mounting portion 210. The transfer leg 212 extends from the first region 212-1 and the driving leg 214 extends from the third region 214-1. Additionally, the trip cam 200 further includes a partially cylindrical-shaped operating handle protrusion 260 that extends from the second region 260-1 and is structured to engage the operating handle 50 (FIGS. 1-4 and 10-12). It will be appreciated that a trip cam may include either one of, or both of the trip indicator leg 220 and the operating handle protrusion 260, without departing from the scope of the disclosed concept. As will be discussed below, the operating handle protrusion 260 advantageously enables the cradle member 40 to cooperate with the operating handle 50.

The operating handle protrusion 260 includes a pair of spaced apart generally planar side surfaces 262,264 and a curved surface 266 connecting the first side surface 262 to the second side surface 264. The side surfaces 262,264 are located between and are preferably parallel to each of the end surfaces 240,242 of the mounting portion 210. As seen in FIG. 7B, the operating handle protrusion 260 substantially extends from the second region 260-1 in a direction 261 generally normal to the direction 215. Additionally, referring to FIGS. 7E and 7F, the operating handle protrusion 260 extends from proximate the end surface 240 to generally midway between the end surfaces 240,242. In this position, the operating handle protrusion 260 is advantageously able to substantially align with and engage a portion of the operating handle 50, as will be discussed in greater detail hereinbelow.

Figure 10:
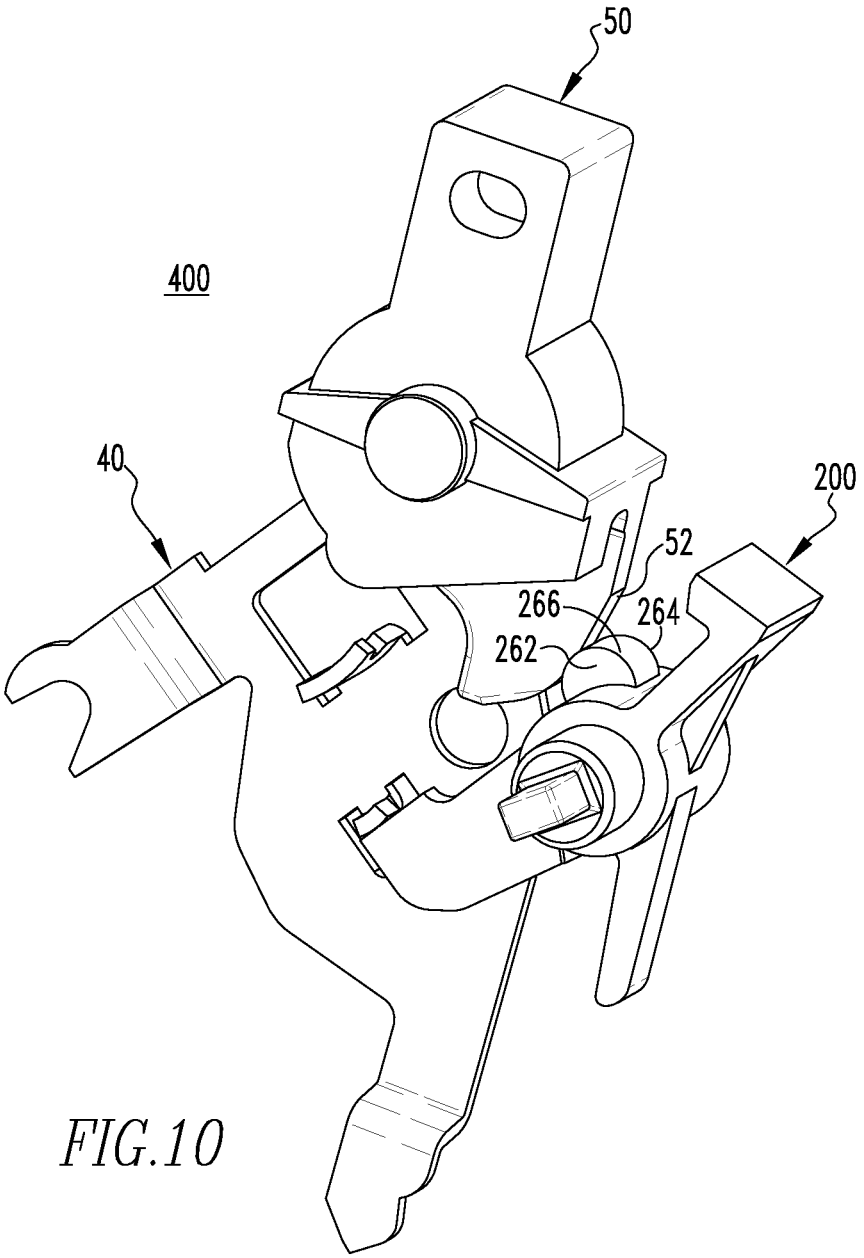
FIG. 10 is an isometric view of an operating handle assembly for the electrical switching apparatus of FIG. 1, showing the cradle member in the TRIPPED position.

FIG. 10 shows an isometric view of an example operating handle assembly 400 for the circuit breaker 2 (FIGS. 1-4), in accordance with the disclosed concept. It will be appreciated that the circuit breaker 2 may include a plurality of operating handle assemblies (i.e., substantially similar to or the same as the operating handle assembly 400) for each of the poles of the circuit breaker 2. As seen, the example operating handle assembly 400 includes the cradle member 40, the trip cam 200, and the operating handle 50.

FIGS. 11 and 12 show different views of the operating handle assembly 400 installed in a portion of the circuit breaker 2. More specifically, the cradle member 40 is structured to move from a CLOSED position (FIG. 11) corresponding to the contacts 102,112 (FIGS. 2-4) being CLOSED to a TRIPPED position (FIG. 12) corresponding to the contacts 102,112 (FIGS. 2-4) having TRIPPED OPEN. As will be discussed below, by employing the operating handle protrusion 260, the operating handle 50 always moves from an ON position to a TRIPPED position after the circuit breaker 2 (FIGS. 2-4, 11 and 12) experiences a tripping event.

As seen in FIG. 10, the operating handle 50 includes an engaging surface 52 structured to engage the curved surface 266 of the operating handle protrusion 260. Because the operating handle protrusion 260 extends from proximate the end surface 240 to generally midway between the end surfaces 240,242 (see for example FIGS. 7E and 7F), it will be appreciated that in operation, the engaging surface 52 is located between the end surface 240 and midway between the end surfaces 240,242. Furthermore, the engaging surface 52 is substantially normal to each of the first side surface 262 and the second side surface 264.

Referring to FIG. 11, in which the cradle member 40 is in the CLOSED position, the operating handle protrusion 260 is spaced from the engaging surface 52. In this position, the operating handle 50 is at an angle 50-1 with the external surface 16 of the housing 10, as shown. Responsive to the cradle member 40 moving from the CLOSED position (FIG. 11) toward the TRIPPED position (FIG. 12), the operating handle protrusion 260 rotates about the mounting portion 210. In this manner, the space between the operating handle protrusion 260 and the engaging surface 52 decreases until the operating handle protrusion 260 engages the engaging surface 52 of the operating handle 50. At this point, because the trip cam 200 is rotating relatively quick, and because of the relative position of the operating handle protrusion 260 (i.e., extending in the direction 261), the operating handle protrusion 260 gives the operating handle 50 a "kick" and drives the operating handle 50 from the ON position to the TRIPPED position. It will however be appreciated that an operating handle protrusion (not shown) in accordance with an alternative embodiment of the disclosed concept may extend in any suitable alternative direction, and/or engage any suitable alternative surface (not indicated) other than the engaging surface 52, and/or be located in any suitable alternative position relative to the mounting portion 210, in order to perform the desired function of driving the operating handle 50 from the ON position to the TRIPPED position.

FIG. 12 shows the operating handle assembly 400 in a position in which the operating handle protrusion 260 is engaging the engaging surface 52 of the operating handle 50 and has caused the operating handle 50 to rotate to the TRIPPED position. Specifically, the operating handle 50 is at an angle 50-2 with the external surface 16 of the housing 10, as shown. The angle 50-2 is greater than the angle 50-1 (FIG. 11).

The operating handle protrusion 260 advantageously imparts an additional force to the operating handle 50 during the tripping operation that is significant enough to always cause the operating handle 50 to rotate to the TRIPPED position. In this manner, frictional forces within the circuit breaker 2 are no longer able to cause the operating handle 50 to get stuck during a tripping operation. Thus, when the circuit breaker 2 undergoes a tripping event (e.g., without limitation, an overcurrent condition), the operating handle 50 always moves from the ON position to the TRIPPED position, advantageously providing a more reliable means for an operator to know whether a circuit breaker has tripped or not, overcoming the disadvantages of known circuit breakers (not shown) which have operating handles (not shown) that often get stuck during a tripping operation due to frictional forces.

Additionally, while the disclosed concept has been described in association with the partially cylindrical-shaped operating handle protrusion 260, it will be appreciated that an operating handle protrusion (not shown) may have any known or suitable alternative shape, and/or configuration with respect to a mounting portion (not shown), in order to perform the desired function of driving the operating handle 50 from the ON position to the TRIPPED position in response to a tripping event. Furthermore, while the trip cam 200 is preferably made of a single piece of material (e.g., without limitation, an injection molded piece), it will be appreciated that an operating handle protrusion (not shown) may be a separate component coupled to a trip cam (not shown), without departing from the scope of the disclosed concept.

Accordingly, it will be appreciated that the disclosed concept provides for an improved (e.g., without limitation, more reliable in terms of correlation between operating handle position and electrical contact position) electrical switching apparatus (e.g., without limitation, circuit breaker 2), and operating handle assembly 400 and trip cam 200 therefor, which among other benefits, provides a mechanism to ensure that the operating handle 50 always rotates to the TRIPPED position during after experiencing a tripping event.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A trip cam for an operating handle assembly of an electrical switching apparatus, said electrical switching apparatus comprising a housing and a number of poles, said operating handle assembly comprising an operating handle partially extending into said housing and a cradle member cooperating with said operating handle, said trip cam comprising:

a mounting portion structured to be disposed in said housing, said mounting portion comprising a first region, a second region disposed generally opposite the first region, and a third region disposed generally between the first region and the second region;

a transfer leg extending from the first region and being structured to cooperate with each of said number of poles;

a driving leg extending from the third region and being structured to be driven by said cradle member; and an operating handle protrusion extending from the second region and being structured to engage said operating handle.

2. The trip cam of claim 1 wherein said operating handle protrusion is partially cylindrical-shaped.

3. The trip cam of claim 2 wherein said operating handle protrusion comprises a first generally planar side surface, a second generally planar side surface spaced from the first side surface, and a curved surface connecting the first side surface to the second side surface.

4. The trip cam of claim 3 wherein the mounting portion comprises a first generally planar end surface and a second generally planar end surface spaced apart and parallel to the first end surface; and wherein each of the first side surface and the second side surface is generally parallel to each of the first end surface and the second end surface.

5. The trip cam of claim 1 wherein said mounting portion is generally cylindrical-shaped and comprises a first end surface and a second end surface opposite and spaced from the first end surface; and wherein said operating handle protrusion is disposed between the first end surface and the second end surface.

6. The trip cam of claim 5 wherein said operating handle protrusion extends from proximate the first end surface to generally midway between the first end surface and the second end surface.

7. The trip cam of claim 1 wherein said driving leg substantially extends from the third region in a first direction; and wherein said operating handle protrusion substantially extends from the second region in a second direction normal to the first direction.

8. An operating handle assembly for an electrical switching apparatus, said electrical switching apparatus comprising a housing and a number of poles, said operating handle assembly comprising:

an operating handle partially extending into said housing;

a cradle member cooperating with said operating handle; and a trip cam comprising:

a mounting portion structured to be disposed in said housing, said mounting portion comprising a first region, a second region disposed generally opposite the first region, and a third region disposed generally between the first region and the second region, a transfer leg extending from the first region and being structured to cooperate with each of said number of poles, a driving leg extending from the third region and being structured to be driven by said cradle member, and an operating handle protrusion extending from the second region and being structured to engage said operating handle.

9. The operating handle assembly of claim 8 wherein said cradle member is structured to move from a CLOSED position to a TRIPPED position; wherein said operating handle is structured to move from an ON position to a TRIPPED position; and wherein, responsive to said cradle member moving from the CLOSED position toward the TRIPPED position, said operating handle protrusion drives said operating handle from the ON position toward the TRIPPED position.

10. The operating handle assembly of claim 9 wherein said operating handle comprises an engaging surface structured to engage said operating handle protrusion; wherein said operating handle protrusion comprises a first generally planar side surface, a second generally planar side surface spaced from the first side surface, and a curved surface connecting the first side surface to the second side surface; and wherein the engaging surface of the operating handle is substantially normal to each of the first side surface and the second side surface.

11. The operating handle assembly of claim 10 wherein, responsive to said cradle member moving from the CLOSED position toward the TRIPPED position, the curved surface of said operating handle protrusion engages the engaging surface of said operating handle.

12. The operating handle assembly of claim 8 wherein said mounting portion is generally cylindrical-shaped and comprises a first end surface and a second end surface opposite and spaced from the first end surface; and wherein said operating handle protrusion is disposed between the first end surface and the second end surface.

13. The operating handle assembly of claim 12 wherein said operating handle protrusion extends from proximate the first end surface to generally midway between the first end surface and the second end surface.

14. The operating handle assembly of claim 8 wherein said driving leg substantially extends from the third region in a first direction; and wherein said operating handle protrusion substantially extends from the second region in a second direction normal to the first direction.

15. The operating handle assembly of claim 8 wherein said operating handle protrusion comprises a first generally planar side surface, a second generally planar side surface spaced from the first side surface, and a curved surface connecting the first side surface to the second side surface; wherein the mounting portion comprises a first generally planar end surface and a second generally planar end surface spaced apart and parallel to the first end surface; and wherein each of the first side surface and the second side surface is generally parallel to each of the first end surface and the second end surface.

16. An electrical switching apparatus comprising:

a housing;

a number of poles; and at least one operating handle assembly comprising:

an operating handle partially extending into said housing, a cradle member cooperating with said operating handle, and a trip cam comprising:

a mounting portion disposed in said housing, said mounting portion comprising a first region, a second region disposed generally opposite the first region, and a third region disposed generally between the first region and the second region, a transfer leg extending from the first region and cooperating with each of said number of poles, a driving leg extending from the third region and being structured to be driven by said cradle member, and an operating handle protrusion extending from the second region and being structured to engage said operating handle.

17. The electrical switching apparatus of claim 16 wherein said cradle member is structured to move from a CLOSED position to a TRIPPED position; wherein said operating handle is structured to move from an ON position to a TRIPPED position; and wherein, responsive to said cradle member moving from the CLOSED position toward the TRIPPED position, said operating handle protrusion drives said operating handle from the ON position toward the TRIPPED position.

18. The electrical switching apparatus of claim 17 wherein said operating handle comprises an engaging surface structured to engage said operating handle protrusion; wherein said operating handle protrusion comprises a first generally planar side surface, a second generally planar side surface spaced from the first side surface, and a curved surface connecting the first side surface to the second side surface; and wherein the engaging surface of said operating handle is substantially normal to each of the first side surface and the second side surface.

19. The electrical switching apparatus of claim 18 wherein, responsive to said cradle member moving from the CLOSED position toward the TRIPPED position, the curved surface of said operating handle protrusion engages the engaging surface of said operating handle.

20. The electrical switching apparatus of claim 16 wherein said electrical switching apparatus is a circuit breaker; wherein said number of poles is a plurality of poles; and wherein said at least one operating handle assembly is a plurality of operating handle assemblies for each of said poles of said circuit breaker.

* * * * *